US006884479B2

(12) United States Patent
Chu et al.

(10) Patent No.: US 6,884,479 B2
(45) Date of Patent: Apr. 26, 2005

(54) INK JET RECORDING ELEMENT

(75) Inventors: Lixin Chu, Rochester, NY (US); Lori J. Shaw-Klein, Rochester, NY (US); Kenneth J. Ruschak, Rochester, NY (US); Elizabeth A. Gallo, Penfield, NY (US); Christine M. Vargas, Churchville, NY (US); Charles R. Salerno, Neward, NY (US)

(73) Assignee: Eastman Kodak Company, Rochester, NY (US)

( * ) Notice: Subject to any disclaimer, the term of this patent is extended or adjusted under 35 U.S.C. 154(b) by 46 days.

(21) Appl. No.: 10/320,293

(22) Filed: Dec. 16, 2002

(65) Prior Publication Data

US 2004/0115368 A1 Jun. 17, 2004

(51) Int. Cl.[7] ..... B41M 5/00

(52) U.S. Cl. ..... 428/32.15; 428/32.26; 428/32.36

(58) Field of Search ..... 428/32.15, 32.26, 428/32.36

(56) References Cited

U.S. PATENT DOCUMENTS

| | | | | |
|---|---|---|---|---|
| 5,352,736 | A | * 10/1994 | Stofko et al. | 525/57 |
| 5,510,004 | A | 4/1996 | Allen | |
| 5,712,027 | A | * 1/1998 | Ali et al. | 428/32.3 |
| 5,965,244 | A | 10/1999 | Tang et al. | |
| 6,114,022 | A | 9/2000 | Warner et al. | |
| 6,140,406 | A | 10/2000 | Schliesman et al. | |
| 6,409,334 | B1 | 6/2002 | Campbell et al. | |

FOREIGN PATENT DOCUMENTS

| | | | |
|---|---|---|---|
| EP | 739747 A2 | * 10/1996 | B41M/5/00 |

* cited by examiner

*Primary Examiner*—Pamela R. Schwartz
(74) *Attorney, Agent, or Firm*—Harold E. Cole; Chris P. Konkol

(57) ABSTRACT

An ink jet recording element having a support having thereon an image-receiving layer of a polymeric network formed by a chemical reaction between a wet-strength polymer, amino-functionalized inorganic particles and a hydrophilic polymer other than a wet-strength polymer.

16 Claims, No Drawings

INK JET RECORDING ELEMENT

CROSS REFERENCE TO RELATED APPLICATION

Reference is made to commonly assigned, co-pending U.S. patent application Ser. No. 101,320,206 by Chu et al., filed of even date herewith entitled "Ink Jet Printing Method".

FIELD OF THE INVENTION

This invention relates to an ink jet recording element, more particularly to an ink jet recording element containing a polymeric network.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink.

Porous inorganic particles, such as silica gel, precipitated silica and clays are widely used in ink jet recording elements because of their highly absorptive properties. For example, EP 0 739 747 A2 and U.S. Pat. Nos. 5,965,244; 6,114,022 and 6,140,406 disclose porous image-receiving layers containing silica gel and/or precipitated silica. However, these types of image-receiving layers often have low mechanical strength or coating integrity due to weak interactions between the porous particles and, therefore, the image-receiving layer can be easily removed from the support upon which it was coated.

U.S. Pat. No. 5,510,004 relates to the use of polymers and copolymers of N,N-diallyl-3-hydroxyazetidinium salts as agents for improving the wet strength of paper. However, there is no disclosure of using these polymers in an image-receiving layer for an ink jet recording element.

U.S. Pat. No. 6,409,334 discloses the use of an amino-silane compound combined with a wet-strength polymer having a reactive azetidinium group in producing an image-receiving layer for an ink jet recording element. However, there is no disclosure of using a non-latex polymeric binder that would react with the azetidinium group such that the integrity of the image-receiving layer would be greatly enhanced.

It is an object of this invention to provide an ink jet recording element that has good image quality with excellent dry time. It is another object of the invention to provide an ink jet recording element having an image-receiving layer of good integrity and sufficient waterfastness.

SUMMARY OF THE INVENTION

These and other objects are achieved in accordance with the invention which comprises an ink jet recording element comprising a support having thereon an image-receiving layer comprising a polymeric network formed by a chemical reaction between a wet strength polymer, amino-functionalized inorganic particles and a hydrophilic polymer other than a wet strength polymer.

By use of the invention, an ink jet recording element is obtained that has a good image quality with an excellent dry time. In addition, the ink jet recording element can be made with a desired coating integrity and waterfastness.

DETAILED DESCRIPTION OF THE INVENTION

As noted above, the image-receiving layer contains a wet-strength polymer or resin. These materials are well known in the paper and pulp industry. These polymers impart wet strength to paper by crosslinking with cellulose, and subsequently self-crosslinking with the fiber structure of the paper web. Useful wet-strength polymers are cationic and water soluble, yet form a water insoluble network with cellulose. Wet-strength polymers are capable of crosslinking with a variety of organic materials other than cellulose and derivatives, including carboxylated and hydroxylated latexes, poly(vinyl alcohol), amine-containing compounds, alginate, polyacrylates, gelatin, starch, and their derivatives.

Preferred wet-strength polymers are polymers prepared by reacting a polyamine or an amine-containing backbone polymer with an epoxide possessing a second functional group, such as an epichlorohydrin, in water. The result is a polymer containing either one or two highly reactive groups: the azetidinium and the epoxide. Such polymers are well known in the art of polymer chemistry, and are available, for example, as the Kymene® series from Hercules Inc. Especially preferred is Kymene® 557LX. The image-receiving layer of the present invention contains the wet strength polymer in an amount of from about 1 to about 10% by weight.

In a preferred embodiment of the invention, the amino-functionalized inorganic particles may be prepared by chemical bond formation between inorganic particles and amino-functionalized silane coupling agents. This chemistry is well known in the art of organosilane chemistry, and is described in, for example, "Silicon Compounds: Register and Review", 5th Edition, available from United Chemical Technologies, Inc. This reference describes the theory and methods for effecting chemical bond formation, and how to select the appropriate inorganic particles and coupling agents for a particular use.

In a preferred embodiment of the invention, the amino-functionalized inorganic particles are prepared by combining an amino-functionalized silane coupling agent and inorganic particles in a ratio of from about 1:5 to about 1:100.

Inorganic particles which may be used to combine with the amino-functionalized silane coupling agent include porous silica particles such as silica gel, precipitated silica, silicates, nonporous silica particles, alumina, boehmite, clay, calcium carbonate, titania, calcined clay, aluminosilicates, and barium sulfate. The particles may be porous or nonporous, and may or may not be in the form of aggregated particles. In addition, the particles must be able to form a chemical bond with silane coupling agents as described below. In a preferred embodiment of the invention, the inorganic particles are porous silica particles such as silica gel, precipitated silica, and silicates.

In another preferred embodiment, the amino-functionalized silane coupling agent has the formula:

$$(R_1)_x Si(OR_2)_y(R_3)_z$$

wherein:

each $R_1$ independently represents an alkyl or aryl group, and at least one $R_1$ is substituted with at least one amino group, such as $NH_2(CH_2)_3$, $NH_2(CH_2)_4$, $NH_2(CH_2)_5$, $NH_2(CH_2)_6$, $NH_2(CH_2)_2NH(CH_2)_2$, $NH_2(CH_2)_3NH(CH_2)_2$, $NH_2(CH_2)_2NH(CH_2)_3$, $NH_2(CH_2)_3NH(CH_2)_3$, $NH_2(CH_2)_2NH(CH_2)(C_6H_4)(CH_2)_2$, $NH_2(CH_2)_6NH(CH_2)_3$, or $NH_2(CH_2)_3OC(CH_3)_2CH{=}CH$;

each $R_2$ independently represents an alkyl or aryl group, such as methyl, ethyl, 2-ethylhexyl, methoxyethoxyethyl, or trimethylsilyl;

each $R_3$ is an alkyl group such as methyl, ethyl, propyl or isopropyl;

x is from 1 to 3;

y is from 1 to 3;

z may be 0, 1 or 2; and the sum of x, y and z is equal to 4.

In another preferred embodiment of the invention, the coupling agent is 3-aminopropyltrimethoxysilane or N-(2-aminoethyl)-3-aminopropylmethyldimethoxysilane. In another preferred embodiment of the invention, between about 1 and 20% by weight of the inorganic particles used in the image-receiving layer are reacted with the amino-functionalized silane coupling agent.

The hydrophilic polymer other than a wet-strength polymer which may be used in the invention may be poly(vinyl alcohol), poly(vinyl pyrrolidone), gelatin, a cellulose ether, a poly(oxazoline), a poly(vinylacetamide), a partially hydrolyzed poly(vinyl acetate/vinyl alcohol), a poly(acrylic acid), a poly(acrylamide), a poly(alkylene oxide), a sulfonated or phosphated polyester or polystyrenes, casein, zein, albumin, chitin, chitosan, dextran, pectin, a collagen derivative, collodian, agar-agar, arrowroot, guar, carrageenan, tragacanth, xanthan, or rhamsan.

In a preferred embodiment, the hydrophilic polymer other than a wet-strength polymer is present in the image-receiving layer in an amount of from about 30 to about 70% by weight.

The ink jet recording element of the invention may also contain other particles such as those described above which are used in preparing the amino-functionalized inorganic particles. These other particles may be used in an amount of from about 10 to about 70% by weight of the image-receiving layer. In a preferred embodiment of the invention, the ratio of amino-functionalized particles to the other particles is from about 1:5 to about 1:100.

Also present in the image-receiving layer is one or more mordanting species or polymers. The mordant may be water soluble or water insoluble such as a soluble polymer, a charged molecule, or a crosslinked dispersed microparticle. The mordant can be non-ionic, cationic or anionic. In one embodiment, the mordant is a water soluble cationic mordant. In a preferred embodiment, the mordant is poly (diallyldimethylammonium chloride). The amount of mordant present is typically up to about 10% by weight.

The dry thickness of the image-receiving layer may range from about 5 to about 30 μm, preferably from about 7 to about 20 μm. The coating thickness required is determined through the need for the coating to act as a sump for absorption of ink solvent and the need to hold the dye or pigment colorant near the coating surface.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 μm, preferably from about 75 to 300 μm. Antioxidants, antistatic agents, plasticizers and other known additives may be incorporated into the support, if desired.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. After coating, the layers are generally dried by simple evaporation, which may be accelerated by known techniques such as convection heating.

To improve colorant fade, UV absorbers, radical quenchers or antioxidants may also be added to the image-receiving layer as is well known in the art. Other additives include adhesion promoters, rheology modifiers, biocides, lubricants, dyes, optical brighteners, matte agents, antistatic agents, etc.

The coating composition can be coated so that the total solids content will yield a useful coating thickness, and for particulate coating formulations, solids contents from 10–60% by weight are typical.

Ink jet inks used to image the recording elements of the present invention are well known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example further illustrates the invention.

EXAMPLE

Element 1 of the Invention

A coating composition was prepared by mixing together 100 g of 6 $\mu$m silica gel Gasil® 23F (INEOS Silicas) and 420 g of water in a glass container. Then, 10 g of 3-aminopropyltrimethoxysilane (United Chemical Technologies, Inc.) was added under vigorous stirring. After stirring for one hour, 170 g of poly(vinyl alcohol) Gohsenol® GH-03 (Nippon Gohsei Co. Ltd.) as a 30% by weight solution was added, followed by 14 g of wet-strength polymer Kymene® 557LX (Hercules Inc.) as a 12.5% by weight solution. Finally, 14 g of mordant poly (diallyldimethylammonium chloride) Nalco CP-261 (Nalco Corp.) was added as a 40 wt. % by weight solution. The mixture was diluted with water to give 25% by weight total solids.

The coating solution was coated on paper at 25° C. using a hand-coating device with a Meyer rod so that the final dry thickness of the image-receiving layer was about 10 g/m$^2$. The paper was Carrara White Nekoosa Solutions Smooth, Grade 5128, Color 9220, (Georgia Pacific Co.) having a basis weight of 150 g/m$^2$. After the composition was coated, it was immediately dried in an oven at 60° C.

Element 2 of the Invention

This element was prepared the same as Element 1 except that N-(2-aminoethyl)-3-aminopropylmethyldimethoxysilane (United Chemical Technologies, Inc.) was used instead of 3-aminopropyltrimethoxysilane.

Comparative Element C-1 (No Amino-Silane or Wet-Strength Polymer)

This element was prepared the same as Element 1 except that 3-aminopropyltrimethoxysilane and Kymene® 557LX were not used.

Comparative Element C-2 (No Wet-Strength Polymer)

This element was prepared the same as Element 1 except that Kymene® 557LX was not used.

Comparative Element C-3 (No Amino-Functionalized Silane Coupling Agent)

This element is the same as Element 1 of the invention except that no amino-functionalized silane coupling agent was used.

Printing

Images were printed on the above elements using a Hewlett-Packard Deskjet® 970 printer with ink cartridges 51645A (black) and C6578DN (color). The images comprised a series of rectangles of cyan, magenta, yellow, black, green, red and blue patches. Each rectangle was 0.8 cm in width and 20 cm in length.

Density Test

Densities of the above patches were measured using an X-Rite® densitometer. There was no significant difference between the densities printed on Elements 1 and 2 of the Invention and Comparative Elements C-1, C-2 and C-3.

Coating Strength Test

The strength of the image-receiving layer was tested by placing a piece of Scotch tape on the coating surface, and then pulling the tape off the coating gently with a consistent force. The coating strength was rated as follows:

Good=no material was taken off by the tape, or the tape could not be removed from the coating without tearing the paper Fair=small amount of material was taken off by the tape Poor=large amount of material was taken off by the tape Waterfastness Test The waterfastness test was performed by placing one drop of water onto various color patches, waiting for 60 seconds, and then removing the water with a piece of tissue. The waterfastness was rated as follows:

Good=little or no color density change

Fair=slightly noticeable change in color density

Poor=large change in color density

The results are shown in the Table below.

TABLE

| Element | Coating Strength Rating | Waterfastness Rating |
|---|---|---|
| 1 | Good | Good |
| 2 | Good | Good |
| C-1 | Poor | Poor |
| C-2 | Fair | Fair |
| C-3 | Fair | Fair |

The above results show that the Elements of the Invention had better coating strength and waterfastness as compared to the Comparative Elements.

The invention has been described in detail with particular reference to certain preferred embodiments thereof, but it will be understood that variations and modifications can be effected within the spirit and scope of the invention.

What is claimed is:

1. An ink jet recording element comprising a support having thereon an image-receiving layer comprising a polymeric network formed by a chemical reaction between a wet strength polymer, amino-functionalized inorganic particles and a hydrophilic polymer other than a wet-strength polymer.

2. The recording element of claim 1 wherein said amino-functionalized inorganic particles in said image-receiving layer are combined with other particles.

3. The recording element of claim 2 wherein said other particles are inorganic particles.

4. The recording element of claim 3 wherein said other inorganic particles comprise silica gel, precipitated silica, or silicates.

5. The recording element of claim 2 wherein said other particles are present in an amount of from about 10 to about 50 % by weight of said image-receiving layer.

6. The recording element of claim 2 wherein the ratio of amino-functionalized particles to said other particles is from about 1:5 to about 1:100.

7. The recording element of claim 1 wherein said wet-strength polymer contains at least one highly reactive group comprising an azetidinium or an epoxide.

8. The recording element of claim 1 wherein said wet-strength polymer is present in said image-receiving layer in an amount of from about 1 to about 10% by weight.

9. The recording element of claim 1 wherein said amino-functionalized inorganic particles are obtained by chemical bond formation between inorganic particles and an amino-functionalized silane coupling agent.

10. The recording element of claim 9 wherein said amino-functionalized silane coupling agent has the formula:

$$(R_1)_x Si(OR_2)_y(R_3)_z$$

wherein:

each $R_1$ independently represents an alkyl or aryl group, and at least one $R_1$ is substituted with at least one amino group;

each $R_2$ independently represents an alkyl or aryl group;

each $R_3$ is an alkyl group;

x is from 1 to 3;

y is from 1 to 3;

z may be 0, 1 or 2; and the sum of x, y and z is equal to 4.

11. The recording element of claim 10 wherein said coupling agent is 3-aminopropyltrimethoxysilane or N-(2-aminoethyl)-3-aminopropylmethyl-dimethoxysilane.

12. The recording element of claim 1 wherein said hydrophilic polymer other than a wet-strength polymer is poly (vinyl alcohol), poly(vinyl pyrrolidone), gelatin, a cellulose ether, a poly(oxazoline), a poly(vinylacetamide), a partially hydrolyzed poly(vinyl acetate/vinyl alcohol), a poly(acrylic acid), a poly(acrylamide), a poly(alkylene oxide), a sulfonated or phosphated polyester or polystyrenes, casein, zein, albumin, chitin, chitosan, dextran, pectin, a collagen derivatives, collodian, agar-agar, arrowroot, guar, carrageenan, tragacanth, xanthan, or rhamsan.

13. The recording element of claim 1 wherein said hydrophilic polymer other than a wet-strength polymer is poly (vinyl alcohol).

14. The recording element of claim 1 wherein said hydrophilic polymer other than a wet-strength polymer is present in said image-receiving layer in an amount of from about 30 to about 70% by weight.

15. The recording element of claim 1 wherein said image-receiving layer has a dry thickness of from about 5 to about 30 $\mu$m.

16. The recording element of claim 1 wherein said support is paper or resin-coated paper.

* * * * *

UNITED STATES PATENT AND TRADEMARK OFFICE

CERTIFICATE OF CORRECTION

PATENT NO. : 6,884,479 B2
DATED : April 26, 2005
INVENTOR(S) : Chu et al.

It is certified that error appears in the above-identified patent and that said Letters Patent is hereby corrected as shown below:

Title page,
Item [*] Notice, insert -- This patent is subject to a terminal disclaimer --.

Column 1,
Line 7, after "Ser. No." delete "101,320,206" and replace with -- 10/320,206 --.

Signed and Sealed this

Fourth Day of October, 2005

JON W. DUDAS
*Director of the United States Patent and Trademark Office*